US005316833A

United States Patent [19]

Davis et al.

[11] Patent Number: 5,316,833

[45] Date of Patent: May 31, 1994

[54] PAPER MACHINE CLOTHING

[75] Inventors: Robert B. Davis, Framingham; Charles E. Kramer, Walpole, both of Mass.; John P. Rooney, Jr., Kalamazoo, Mich.; Chunghi H. Park, Sharon, Mass.; Dana B. Eagles, Sherborn, Mass.; Joseph G. O'Connor, Hopedale, Mass.; Chian-Hsiang Lin, Lexington, Mass.; Kathleen A. Tabis, Warwick, R.I.; Maryann C. Kenney, Foxboro, Mass.; Jeffrey A. Emond, South Windsor, Conn.

[73] Assignee: Albany International Corp., Albany, N.Y.

[21] Appl. No.: 992,624

[22] Filed: Dec. 18, 1992

[30] Foreign Application Priority Data

Feb. 18, 1991 [GB] United Kingdom ..... 9103340
Jun. 3, 1991 [GB] United Kingdom ..... 9111862

[51] Int. Cl.[5] ..... D03D 3/00

[52] U.S. Cl. ..... 428/225; 8/115.56; 8/DIG. 21; 428/229; 428/234; 428/300

[58] Field of Search ..... 8/115.56, DIG. 21; 428/225, 229, 234, 300

[56] References Cited

U.S. PATENT DOCUMENTS 2,425,334 8/1947 MacCreath .
3,313,645 4/1967 Wagner et al. .
3,386,849 6/1968 Tewksbury .
4,119,745 10/1978 Gisbourne .

FOREIGN PATENT DOCUMENTS 392682 10/1990 European Pat. Off. .
1393676 3/1965 France .
2329798 5/1977 France .

*Primary Examiner*—James J. Bell
*Attorney, Agent, or Firm*—Kane, Dalsimer, Sullivan, Kurucz, Levy, Eisele and Richard

[57] ABSTRACT

This invention relates to paper machine clothing and has particular reference to paper machine clothing suitable for use in the forming, presing and drying sections of a papermakng machine and comprises a monofilament and/or staple fibre in which themonofilament or staple fibre comprises a polyamide material which has been subjected to a treatment with an aqueous solution of aldehyde in the presence of a catalyst to effect partial cross-linking of the polyamide to provide a gel content thereof within the range of 0.1–75%.

16 Claims, 2 Drawing Sheets

PAPER MACHINE CLOTHING

DESCRIPTION

This invention relates to paper machine clothing and has particular reference to paper machine clothing suitable for use in the forming, pressing and drying sections of a papermaking machine.

In papermaking machines, a slurry of papermaking constituents, referred to as "furnish", is deposited on a fabric or "wire" and a liquid constituent of the furnish is drawn or extracted through the fabric or wire to produce a self-cohesive sheet. This self-cohesive sheet is then passed to a pressing and drying section of a papermaking machine. In the pressing section of the machine, the paper sheet is transported by a fabric to a pair of rollers where the fabric and paper sheet are passed between the nip of the rollers to dewater and dry the paper sheet. After leaving the pressing section of the machine, the paper sheet then passes to a drying section of the machine where it is dried at an elevated temperature. The paper machine fabric in the drying section of the machine together with its sheet of paper is subjected to an elevated temperature in a rigorous chemical envirorment. Paper machine clothing employed in the papermaking industry has traditionally been formed from a variety of materials and constant research is taking place to improve the performance of such materials. The paper sheet itself contains all types of chemical finishes and will be at the same time subjected to an elevated temperature in order to aid dewatering and drying. It follows, therefore, that paper machine clothing whether in the pressing section or in the drying section experiences a rigorous mechanical environment while at the same time being challenged by aggressive chemicals at elevated temperatures.

Many materials have been proposed for use in papermaking machine clothing, but one of the materials which forms at least part of most papermaking machine fabrics is polyamide. Polyamides, particularly polyamide 6 and polyamide 6,6 have been found over the years to give consistently reproducible results with reasonable durability in service.

As the papermaking process develops, the move is towards much faster machine speeds together with higher temperatures and increasing usage of chemicals. This changing environment has resulted in a steady reduction in the effective life of traditional materials used in current paper machine clothing.

Considerable research has been conducted into the ways of improving existing materials and for the production of new materials suitable for use in these more demanding environments. Many new materials are now appearing in the marketplace in an attempt to deal with this overall problem; but in the meantime, attempts have also been made to effect treatment of existing materials to reinforce their suitability. Many proposals have been put forward for improving the mechanical, thermal, and chemical properties of polyamides; among these is the general principle of cross-linking. The cross-linking of polyamide materials is well known, but one of the undesirable properties of a highly crosslinked polyamide material is that it becomes brittle. In use in the form of a staple fibre in the production of a batt layer of a papermaking machine fabric, highly crosslinked polyamide materials tend to fibrillate and break under the repeated loads in the pressing section of the paper machine with the result that fabric life is relatively short.

U.S. Pat. No. 2,425,334 discloses one process for modifying the properties of synthetic linear polyamide articles in the form of filaments, bristles, yarns and the like which have not been cold drawn to render the article incapable of being cold drawn by more than about 75% of their original length, said process comprising impregnating the shaped undrawn polyamide article in the form of filaments, bristles, yarns and the like with an aqueous solution having a pH not greater than 3 and having dissolved therein in at least 20% by weight of formaldehyde, a catalyst selected from the group consisting of acids having an ionization constant of at least $1.0\times10^{-2}$ at 25° C. and water soluble ammonium, amine, metallic salts of these, removing the surface liquid adhering to the article to prevent tendering on subsequent baking and then baking the impregnated article at a temperature of 100° to 150° C.

Such a process results in yarns, bristles, filaments and fibres having increased heat stability, softening point, receptivity to dye stuffs and, at the same time, improved resistance to fatigue. Furthermore, such materials tend to be less soluble in organic liquids which would, normally, dissolve the untreated polyamide. Such materials are not satisfactory candidates for paper machine clothing, since they exhibit the properties of increased stiffness and therefore brittleness.

The present Applicants have found, however, that by controlling the extent of the cross-linking, materials can be produced which exhibit superior properties of longevity and are not subjected to breakage or fibrillation in service.

According to one aspect of the present invention, there is provided an article of paper machine clothing comprising monofilament and/or staple fibre in which the monofilament or staple fibre comprises a polyamide material which has been subjected to a treatment with an aqueous solution of aldehyde in the presence of a catalyst to effect partial cross-linking of the polyamide such that the partially cross-linked polyamide has a gel content within the range of 0.1–75%.

In a particular aspect of the invention the gel content may be within the range 10% to 65%, typically 20% to 55%. In another aspect of the invention, the polyamide exhibits a reduction of crystallinity in the range of 1–25% compared with the uncrosslinked material. Mechanical, chemical and thermal properties of such an article of papermaking machine clothing made therefrom are significantly enhanced and thus prolong fabric longevity.

In another aspect of the invention, there is provided an article as claimed in claim 1 wherein the partially cross-linked polyamide has a reduced crystallinity compared with the uncrosslinked material by an amount within the range of 10–65%.

Typical catalysts which may be used in accordance with the present invention are ammonium, amine or metallic salts of these, and mixture of metallic salts with acids. Such catalysts used in the invention included potassium hydrogen sulphate, potassium chloride, potassium iodide, potassium bromide, aluminium sulphate, calcium chloride, magnesium chloride, ammonium sulphide, ammonium sulphomate, ammonium bisulphite, and ammonium nitrate. A proportion of organic or inorganic acid such as formic acid, oxalic acid, citric acid, phosphoric acid, and phosphorous acid, has been found to enhance the results.

The aldehyde is preferably present within an amount of 5–30% typically 10–20% by weight. The catalysts may be present in an amount of 1–5% by weight. The aldehydes used in the present invention include:

(i) Formaldehyde with a mixture of metal salts (e.g. $MgCl_2$ with poly basic organic acids (e.g. citric acid).

(ii) Aldehydes and Dialdehydes (e.g. glyoxal) and mixtures of these with formaldehyde.

(iii) Polyoxymethylene compounds and polymeric acetals prepared from formaldehyde and polyols.

(iv) Formaldehyde derivatives such as

Linear finishing agents: Urea-formaldehyde, carbamates (e.g. 2-methoxyethylcarbamate and hydroxymethylated isopropylcarbamate)

Cyclic ureas (e.g. dihydroxy-4,5.-dihydroxyethylene urea).

Amino triazines (e.g. N-methyolated melamines).

The aqueous aldehyde together with the catalyst are preferably applied to the fibre at or above the glass transition temperature thereof. it has been found that by controlling the cross-linking to produce a gel content within the range specified, a network of crosslinks are produced within the entire structure. It is thought that this crosslinked network within the structure tends to be "elastic" in that it has the ability to absorb kinetic energy and to dissipate that energy through such elastic linkages without causing disruption of the molecules by covalent bond breakage. The crosslinked materials tend to resist damage from deformation due to the presence of the network of molecular chains and enprove the mechanical properties.

The invention has been found to be particularly advantageous in the treatment of polyamide 6 and polyamide 6,6 materials, and also polyamides 3; 4; 7; 8; 9; 10; 11; 12; 13; 6,8; 6,9; 6,10; 6,12; 12,12 Qiana (polyamide derived from bis-para-aminocyclohexylmthane and dodecanoic acid); polyamide 6,6T (polyamide made by condensing of E-caprolactam with hexamethylenediamine with terephthalic acid): Nomex; Trogamid T (trademark of Dynamit Nobel for polyamide of dimethylterephthalate and trimethylhexamethylane dismine); Impact modified polyamides (e.g. Grilon A-28NX, A28NY and A28NZ, or Capron from Allied); Pebax (polyether block polyamides)(tradename of Rilsan); and compatibilized blends of polyamide such as blends with polyethylene, polypropylene, and polyphenylene oxide.

Articles of paper machine clothing in accordance with the present invention have been found to be particularly useful in the pressing section of a papermaking machine. The introduction of the technique of impulse drying has generated a requirement for improved temperature resistance; such a requirement has been found to be met by paper machine clothing in accordance with the invention.

Following is a description by way of example only and with reference to the accompanying drawings of methods of carrying the invention into effect:

EXAMPLE 1

Figure 1:
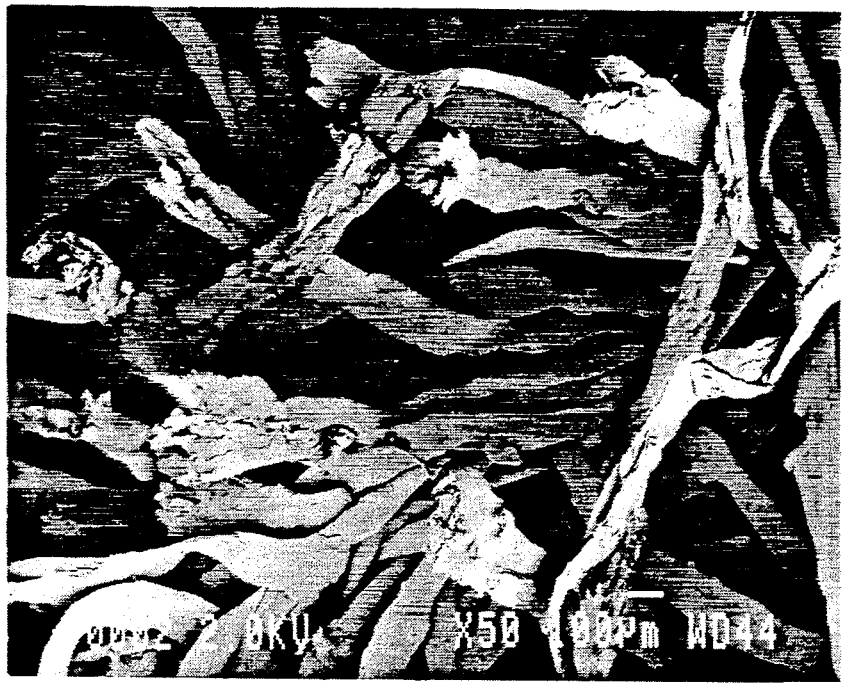
FIG. 1 is a SEM (scanning electron microscope) micrograph of a standard prior art polyamide 6,6 fibre after one million compressions.

A treatment solution was prepared comprising 5536 grams of deionized water to which was added 2736 grams of formaldehyde as a 37% aqueous solution, 76 grams of potassium chloride, 42 grams of oxalic acid. The pH was checked and maintained below 3.

Samples of polyamide 6,6 15 dpf staple fibre commercially available from Du Pont and made from "ZYTEL" resin was scoured by treatment with warm water containing 80 grams of tetra-sodium pyrophosphate and 32 ml of Triton X-100 a non-ionic surfactant from Rohm Haas, per 32 liters. The initial temperature was approximately 40° C. and this was brought to a starting temperature of 55° C. by circulating steam in a jacket about the kettle. Some 1600 grams of commercial PA 6,6 fibre was then added to the kettle and was maintained at a temperature within the range of 53°–55° C. for a period of 30 minutes. At the end of the scouring period the fibre was rinsed with cold tap water three times and allowed to drain during each rinse cycle. After the rinse, no suds were present in the kettle. The sample was then squeezed, and dried over a period of approximately 24 hours under room temperature conditions.

The treatment solution was then placed in a vessel and brought to the desired temperature of 65° C., 80° C., or 95° C. A scoured fibre sample (140 grams) was then placed in the vessel and the desired temperature was maintained throughout the fibre immersion period. At the end of the specified time period, the fibre was removed and placed in a well ventilated hood for several hours. Thereafter, the fibre was then transferred to a forced air oven at a temperature of 45° C. for 3 hours. The fibre was then removed and the temperature of the oven adjusted to 145° C. whereupon the fibre was returned to the oven for a 15 minute period. After the high temperature oven treatment, the fibre was then rinsed in tap water until the rinse water had a pH of not less than 5. The fibre was then dried in a forced air oven at 45° C. for 3 hours.

A test fabric was prepared with fibre treated as above together with a scoured control sample for comparison. The samples were formed into a carded batt and positioned as the upper layer of a needled fabric, and the resultant fabric was then run in a wet environment on an experimental press to subject the material to repetitive cycling through the nip of an experimental press. After a million compressions, the fabric was removed from the press and the individual samples were examined under an optical microscope. The fibre samples were then generally correlated by inspection with a "ranking" on a scale of 1 to 5 for appearance based on flattening and fibrillation. A ranking of one indicates no substantial change while a ranking of five shows fibres which have been extensively flattened and fibrillated and have no residual resilience whatsoever.

The results were extremely interesting in that the sample 3 in Table 1 of PA 6,6 treated above had a ranking of 2.5 whereas the scoured control had a ranking of 3.8. A ranking difference of 0.5 is considered significant. The ranking of 2.5 after a million compressions was one of the most outstanding results ever produced by this kind of test.

Figure 2:
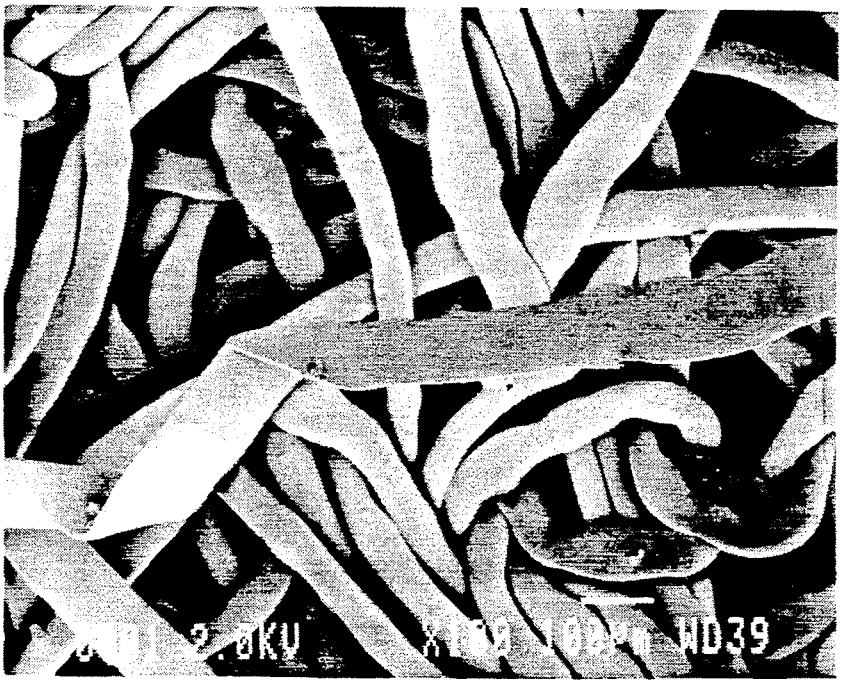
FIG. 2 is a SEM micrograph of a polyamide 6,6 fibre in accordance with the present invention when subjected to the same treatment as the fibre of FIG. 1.

As can be seen by comparing FIGS. 1 and 2, the untreated polyamide 6,6 fibres were substantially flattened while the cross-linked fibres retained much of their original shape and structure.

Figure 3:
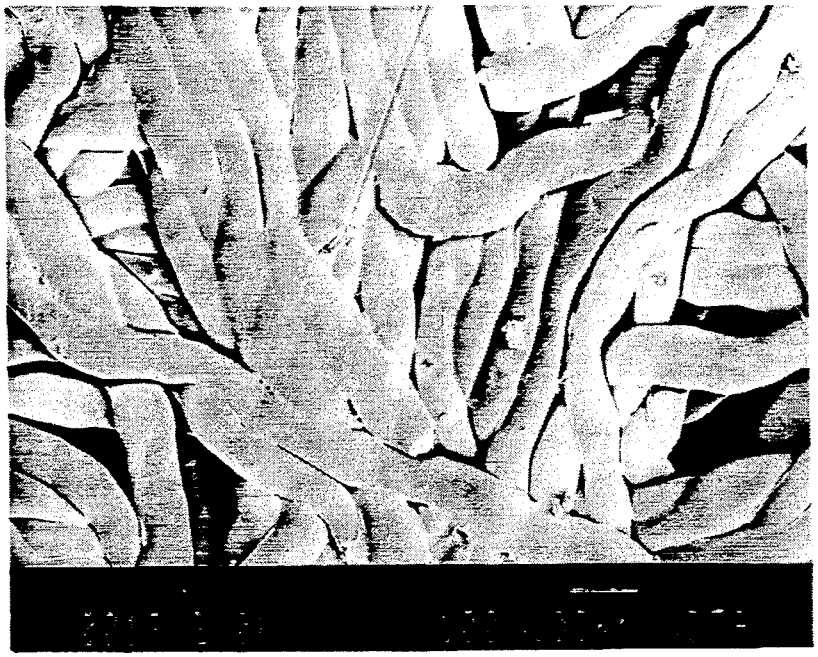
FIG. 3 is a SEM micrograph of a sample of the fibre of FIG. 1 after treatment in a heated platen press.
Figure 4:
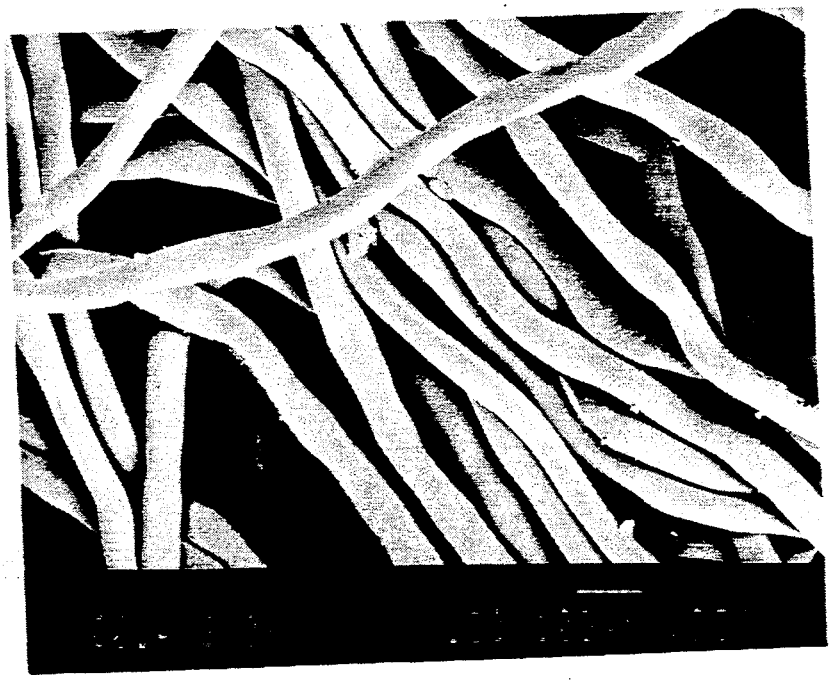
FIG. 4 is a SEM micrograph of a sample of the fibre of FIG. 2 after being subjected to the same treatment as the fibre of FIG. 3.

In another test, fibre samples of untreated polyamide 6,6 and cross-linked polyamide 6,6 in accordance with the present invention were each treated by subjecting to pressure in a platen press at a temperature of 400° F. and a pressure of 800 psi for a period of 5 secs. The effect of this treatment on each sample can be seen in FIGS. 3 and 4 respectively; namely that the standard untreated sample is substantially flattened and fused, while the sample in accordance with this example is little effected.

The accompanying Table illustrates the thermal and gel content of fibres variously treated in accordance with the present invention:

TABLE 1

| Thermal Properties and Gel Content of 15 denier per filament (dpf) polyamide. | | | | | |
|---|---|---|---|---|---|
| | Crystalline Transition Temperature (°C.) | | ΔH (J/g) | | Gel |
| Sample ID | 1st Heat | 2nd Heat | 1st Heat | 2nd Heat | Content (%) |
| AS Received | 257.9 | 235.1 259.8 | 79.8 | 69.1 | 0.0 |
| Scoured Control | 259.3 | 237.1 259.1 | 86.7 | 68.5 | 0.0 |
| 1 | 255.8 | 250.8 258.9 | 76.6 | 67.6 | 0.3 |
| 2 | 233.8 249.3 252.1 | 242.3 (Broad Peak) | 75.1 | 52.1 | 32.2 |
| 3 | 227.1 236.5 243.1 | 217.4 (Broad Peak) | 63.9 | 36.7 | 62.0 |
| 4 | 221.8 | (Broad Peak) | 54.5 | — | 67.1 |
| 5 | 229.3 | (Broad Peak) | 61.3 | — | 74.9 |

It will be seen from the foregoing that as the reaction density is increased, the crystalline transition temperature is lowered and broadened and the original character of the fibre is dramatically changed. The crystallinity of the fibre decreases. The gel content of the fibres in accordance with the present invention increases and an optimal fibre for use in pressing applications will have a crystalline transition temperature within the range of 220°-245° C. on heating with a broad, undefined transition peak for the second heating; a gel content within the range of 1-75% has been found to give excellent results. This results in a reduction of crystallinity of 1-25%.

The fibres treated in accordance with the present invention also show improved chemical resistance. Fibre samples were immersed in 35% wt/wt hydrogen peroxide buffered to pH2 at 60° C. for 24 hours. The tensile strength on wet fibre was measured before and after exposure and the percent retained tensile strength was determined.

Three cross-linked samples of fibres as treated above were subjected to treatment times and temperatures as set out in Table II below. The samples were also tested on an experimental press, and the results are also shown in Table II.

TABLE II

| Sample ID | Treatment Conditions | Gel Content (%) | Experimental Press Ranking | Tensile Strength Retain after Expose to $H_2O_2$ |
|---|---|---|---|---|
| As Received | — | 0.0 | 3.8 | 38 |
| 1 | 60° C./20 minutes | 0.3 | 4.3 | 82 |
| 2 | 80° C./30 minutes | 32 | 2.8 | 85 |
| 3 | 95° C./2 hours | 64 | 2.5 | 83 |

Although the chemical resistance of all treated samples show improvement, the lower gel content sample shows poor mechanical durability in the experimental press, as indicated by a 4.3 ranking.

EXAMPLE 2

Fibres were prepared the same as in Example 1 except the amount of 37% formaldehyde solution used was 684 in a total of 8390 grams of treat solution. In one case fibre was treated at 95° C. for 30 minutes and after testing on the experimental press had a ranking of 2.5. A second fibre batt was prepared treating at 95° C. for 2 hours and after testing on the experimental press had a ranking of 2.5.

EXAMPLE 3

A treatment solution was prepared comprising 69.6 wt % of water to which was added 25 wt % of dimethylodihydroxyethyleneurea (DMDHEU) available from American Cyanamid as a 44% aqueous solution, 5 wt % of magnesium chloride, and 0.4wt % of Witconate 60T surfactant availalble from Witco. The pH was adjusted to 3.

Polyamide 6,6 15 dpf fibre commercially available from Du Pont made from ZYTEL resin was scoured as detailed in Example 1. The treatment solution prepared above was then placed in a vessel and brought to the desired temperature of 85° C. The scoured fibre sample was then placed in the vessel and the desired temperature was maintained throughout the fibre immersion period. At the end of 30 minutes, the excess solution was squeezed out and placed in a forced air oven at 70° C. for 30 minutes. The fibre was then removed and the temperature of the oven adjusted to 160° C. whereupon the fibre was returned to the oven for a 5 minute period. After the high temperature oven treatment, the fibre was then rinsed in warm tap water. The fibre was then dried in a forced air oven at 45° C. for 3 hours. The gel content for the fibre sample treated in this Example was 39.4%.

A test fabric was prepared with these treated fibres as described in Example 1. After 970,000 compressions, the fabric was removed and the sample was ranked as described in Example 1. The ranking for treated fibres in this Example was 3.3 compared to 3.8 for untreated control material.

EXAMPLE 4

Fibres were prepared the same as in Example 3, except the pH was adjusted to 1.3. In this Example, fibre was treated at 65° C. for 30 minutes. The gel content of fibre from this treatment was 28.3%. The experimental press ranking was 3.3 for the treated fibre compared to 3.8 for the untreated control material.

EXAMPLE 5

A treatment solution was prepared comprising 69.6 wt % of water to which was added 25 wt % of Aerotex 900 available from American Cyanamid as a 44% aqueous solution of DMDHEU available from American Cyanamid, 5 wt % of magnesium chloride and 0.4 wt % of Witconate 60T surfactant available from Witco. The pH was adjusted to 3.5.

Polyamide 6,6 15 dpf fibre commercially available from Du Pont made from ZYTEL was scoured as detailed in Example 1. The treatment solution prepared above was then placed in a vessel and brought to the desired temperature of 65° C. The scoured fibre sample was then placed in the vessel and the desired temperature was maintained throughout the fibre immersion period. At the end of 30 minutes, the excess solution was squeezed out and placed in a forced air oven at 70° C. for 30 minutes. The fibre was then removed and the temperature of the oven adjusted to 160° C. whereupon the fibre was returned to the oven for a 5 minute period. After the high temperature oven treatment, the fibre was then rinsed in warm tap water. The fibre was then dried in an air forced oven at 45° C. for 3 hours. The gel content for the fibre treated in this Example was 22.6%. The experimental press ranking was 3.0 for the treated fibre compared to 3.8 for the untreated control material.

EXAMPLE 6

Polyamide 6,6 15 dpf fibre from Du Pont made from "ZYTEL" resin was prepared the same as in Example 5, except the treatment was done at 82° C. for 15 minutes. The gel content of fibre from this treatment was 10.8%. The experimental press ranking was 3.0 for the treated fibre compared to 3.8 for the untreated control material.

EXAMPLE 7

Fibres were prepared the same as in Example 1 except the fibre type was Grilon TN12R polyamide 6 15 dpf fibre commercially available from Grilon. The gel content of fibre from this treatment was 38%. A test fabric was prepared with these treated fibres as described in Example 1. After 970,000 compressions, the fabric was removed and the sample was ranked as described in Example 1. The ranking for treated fibres in this Example was 3.0 compared to 3.5 for untreated control material.

EXAMPLE 8

A treatment solution was prepared comprising 5536 grams of deionized water to which was added 2736 grams of formaldehyde as a 37% aqueous solution, 76 grams of potassium chloride, 42 grams of oxalic acid, 84 grams of Witconol 60T anionic surfactant available from Witco. The pH was adjusted to 2.3.

Samples of polyamide 6,6 6 dpf available from Du Pont made from "ZYTEL" resin were scoured by treatment with warm water containing 80 grams of tetrasodium pyrophosphate and 32 ml of Triton X-100, per 32 liters. The initial temperature was approximately 40° C. and this was brought to a starting temperature of 55° C. by circulating steam in a jacket about the kettle. Some 1600 grams of PA 6,6 6 dpf fibre was then added to the kettle and was maintained at a temperature within the range of 53°-55° C. for a period of 30 minutes. At the end of the scouring period, the fibre was rinsed with cold tap water three times and allowed to drain during each rinse cycle. After the rinse, no suds were present in the kettle. The sample was then squeezed and dried over a period of approximately 24 hours under room temperature conditions.

The treatment solution prepared above was then placed in a vessel and brought to the desired temperature of 80° C. A scoured PA6,6 6 dpf fibre sample (560 grams) was then placed in the vessel and the desired temperature was maintained throughout the fibre immersion period. The fibre was then transferred to a forced air oven at a temperature of 45° C. for 3 hours. The fibre was then removed and the temperature of the oven adjusted to 145° C. whereupon the fibre was returned to the oven for a 15 minute period. After the high temperature oven treatment, the fibre was then rinsed in tap water until the rinse water had a pH of not less than 5. The fibre was then dried in a forced air oven at 45° C. for 3 hours. The gel content of the fibre prepared in this Example was 32.0%.

The sample of PA 6,6 treated above had an experimental press ranking of 3.0 whereas the control had a ranking of 3.8 after 970,000 compression cycles on the experimental press.

EXAMPLE 9

Samples of BASF ULTRAMID T polyamide 6,6T 15 dpf commercially available from BASF under the trade name "ULTRAMID T" were prepared on a pilot scale melt extruder. The multifilament was crimped, cut into staple length and opened on a laboratory card. This fibre was scoured as described in Example 1.

The fibre was treated the same as Example 8, except the treatment temperature was 95° C. for 30 minutes.

A fabric sample was prepared for evolution on the experimental press as described in Example 1. The sample of PA 6,6T treated above had a ranking of 2.3 whereas the untreated control PA 6,6T had a ranking of 5.0 after 970,000 compression cycles on the experimental press.

We claim:

1. In an article of paper machine clothing comprising a base fabric having a carded batt of staple fibers needled into an upper layer thereof, said staple fibers comprising a polyamide material, the improvement comprising staple fibers of a polyamide material which have been subjected to a treatment with an aqueous solution of aldehyde in the presence of a catalyst to effect partial cross-linking of the polyamide to provide a gel content thereof within the range of 0.1-75% accompanied by a reduction in crystallinity in the range of 1-65% compared with the uncrosslinked material.

2. In an article of paper machine clothing, said article comprising a fabric including monofilament of a polyamide material, the improvement comprising monofilament of a polyamide material which has been subjected to a treatment with an aqueous solution of aldehyde in the presence of a catalyst to effect partial cross-linking of the polaymide to provide a gel content thereof within the range of 0.1-75% accompanied by a reduction in crystallinity in the range of 1-65% compared with the uncrosslinked material.

3. An article as claimed in claim 1 or 2, wherein the partially cross-linked polyamide has a reduced crystallinity compared with the uncrosslinked material by an amount within the range of 10-65%.

4. An article as claimed in claim 1 or 2, wherein the crosslinking is conducted to the extent that the gel content is within the range of 20 to 55%.

5. An article as claimed in claim 1 or 2, wherein the catalyst is selected from ammonium, amine or metallic salts thereof and mixtures of metallic salts with acids.

6. An article as claimed in claim 1 or 2, wherein the catalyst is selected from potassium hydrogen sulphate, potassium chloride, potassium iodide, potassium bromide, aluminum sulphate, calcium chloride, magnesium chloride, ammonium sulphide, ammonium sulphamate, ammonium bisulphite and ammonium nitrate.

7. An article as claimed in claim 1 or 2, wherein the catalyst comprises an organic or inorganic acid.

8. An article as claimed in claim 7, wherein the organic or inorganic acid is selected from formic acid, oxalic acid, citric acid, phosphoric acid, and phosphorous acid.

9. An article as claimed in claim 1 or 2, wherein the aldehyde is present within an amount of 5–30% by weight.

10. An article as claimed in claim 1 or 2, wherein the aldehyde is present in an amount of 10–20% by weight.

11. An article as claimed in claim 1 or 2, wherein the catalyst is present within an amount of 1–5% by weight.

12. An article as claimed in claim 1 or 2, wherein the aldehyde is selected from formaldehyde, aldehydes and dialdehydes.

13. An article as claimed in claim 1 or 2, wherein the aldehyde is selected from one or more of polyoxymethylene compounds and polymeric acetals prepared from formaldehyde and polyols.

14. An article as claimed in claim 1 or 2, wherein the aldehyde is a formaldehyde derivative selected from ureaformaldehyde, carbamates, cyclic ureas and amino triazines.

15. An article as claimed in claim 1 or 2, wherein the aqueous aldehyde together with a catalyst is applied tot he fibre at or above the glass transition temperature of the fibre.

16. An article as claimed in claim 1 or 2, wherein the polyamide is selected from polyamide 5, polyamide 6,6 polyamide 3, polyamide 4, polyamide 7, polyamide 9, polyamide, 8, polyamide 10, polyamide 11, polyamide 12, polyamide 13, polyamide 6,8, polyamide 6,9, polyamide 6,10, polyamide 6,12, polyamide 12,12, polyamide 6,6T and the polyamide of dimethylterephthalate and trimethylhexamethylene diamine, polyether block polyamides, compatible blends of polyamide with polyethylene, polypropylene and polyphenylene oxide.

* * * * *